United States Patent [19]

Matsumoto

[11] Patent Number: 4,573,383

[45] Date of Patent: Mar. 4, 1986

[54] APPARATUS FOR FORMING GAPS IN A SLIDE FASTENER CHAIN

[75] Inventor: Masao Matsumoto, Toyama, Japan

[73] Assignee: Yoshida Kogyo K.K., Japan

[21] Appl. No.: 564,026

[22] Filed: Dec. 21, 1983

[30] Foreign Application Priority Data

Dec. 23, 1982 [JP] Japan ..... 57-229233

[51] Int. Cl.[4] ..... B26D 1/11; B21D 53/50; A41H 37/06

[52] U.S. Cl. ..... 83/11; 83/465; 83/620; 83/921; 29/33.2; 29/408

[58] Field of Search ..... 83/111, 465, 620, 622, 83/697, 921; 29/408, 33.2

[56] References Cited

U.S. PATENT DOCUMENTS 4,131,223 12/1978 Aureli ..... 83/620 X

*Primary Examiner*—James M. Meister

*Attorney, Agent, or Firm*—Hill, Van Santen, Steadman & Simpson

[57] ABSTRACT

A space forming apparatus for producing an element-free space section of predetermined length at predetermined intervals in continuous slide fastener chain. Said apparatus comprises a transfer table for intermittently transferring the continuous slide fastener chain, a die disposed in the center of the transfer table, a punch disposed opposite to the die and having a longitudinal length substantially the same as that of the spaced sections to be formed, said punch being provided with a center projecting rib extending along a center line of a punch body, a pair of parallel inner cutting blades disposed on the both sides of the rib and a pair of parallel outer cutting blades disposed on the outer side each of the inner cutting blades, and a chain fixing device located on both sides of the die and opposite sites to them for clamping and securing the right and left stringers when the severed fragments of the coupling elements are removed from the sewing threads.

6 Claims, 16 Drawing Figures

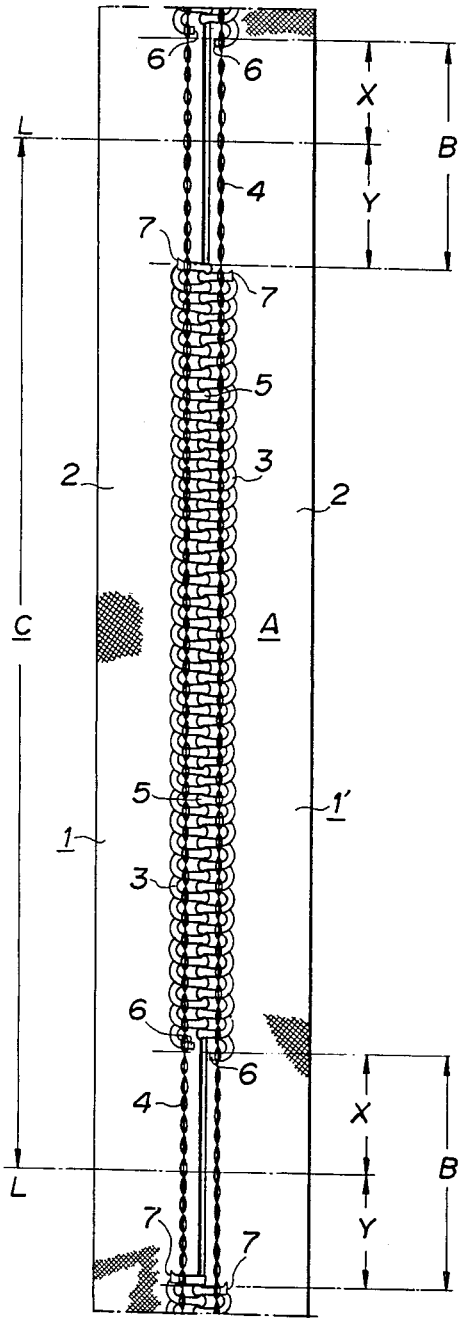
FIG. 1
FIG. 6
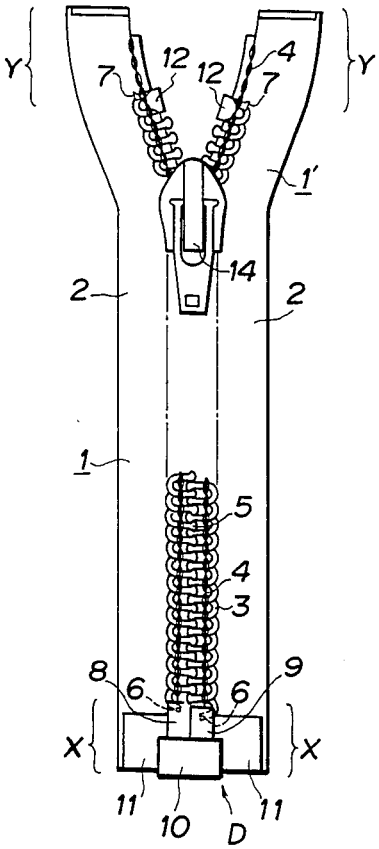

APPARATUS FOR FORMING GAPS IN A SLIDE FASTENER CHAIN

FIELD OF THE INVENTION

The present invention relates in general to a continuous synthetic resin slide fastener chain with spaced sections of a predetermined length spaced at predetermined intervals along the length of the chain, intended for mass-production from this chain of a synthetic resin slide fastener with a separator attached thereto, and techniques associated therewith. In particular, this invention relates, first, to such a continuous synthetic resin slide fastener chain that is produced from a pair of stringers composed of tapes, to the inner edge of each of which a pair of interlocking coil elements of synthetic resin monofilament are sewn, by clearing the pair of stringers at predetermined equidistant points of opposite sections of such interlocking coil elements over a predetermined length so as to form spaced sections or element-free sections thereon, to a method of producing such a continuous slide fastener chain, to an apparatus for producing the same, and to punch means designed to form the element-free sections in the same. In the second place, this invention is directed to a slide fastener that is produced by the cutting of such a continuous synthetic resin slide fastener chain at the spaced sections and assembling a separator, a slider and an upper stop thereto.

BACKGROUND OF THE INVENTION

A conventional method of producing in automatic highspeed mode a slide fastener with a separator consists in the main of:

(1) producing a pair of stringers by attaching by sewing to a pair of tapes placed side by side along the opposing inner edge of each, interlocking coil coupling elements of synthetic resin monofilament;

(2) producinga continuous synthetic resin slide fastener chain by removing a predetermined length of the coupling elements from the stringers at a predetermined intervals so as to form spaced sections or element-free sections thereon;

(3) producing a plain slide fastener chain by the cutting of such a continuous synthetic resin slide fastener chain at spaced sections; and, (4) completing as a product the slide fastener by furnishing this plain slide fastener chain at its ends with a top stop and a separator composed of pin, or male member, box, and box pin or female member respectively, and a slider for free vertical movement along the coupling elements.

Japanese Opened Patent Application No. 156104/81, filed by this applicant, disclosed the method of forming an element-free section or spaced section in a continuous slide fastener chain, in a manner as illustrated by above step (2). According to this patent application, a punch with a single cutting edge of length related with the longitudinal dimension of the segment-free section cuts the loops or winds of the right and left coil coupling elements, as they are interlocked in stringers, on the inner sides each of the threads that fix them to the tapes. At the subsequent stage, to form the spaced section, the severed coil element fragments are extracted by plucking them adjacent to the cut ends between the threads. However, this process has certain disadvantages. For example, the coil element fragments offer a considerable resistance against pull since they are tightly entwined with the threads. As a result, fragments remain unremoved in the threads or, in an extreme case, break the thread. Further, cutting in this manner would leave the coil elements with free bent ends where cut which extend too far out from the sewing threads into the spaced section thus formed. When a top stop is attached to the stringer on this side, these cut ends can be left protruding from the top stop. Consequently, the user, when wearing clothing or the like to which this coil element slide fastener is attached, will come into contact with, and be hurt by, the protruding coil ends, so that the fastener has a disagreeable touch and feel.

An improved approach for overcoming the above mentioned disadvantages has been made by this applicant, which is disclosed in Japanese Utility Model Application No. 197537/81. According to this, a punch with two cutting edges, spaced in parallel and of a length equal to the dimension of the spaced section, cuts the loops or winds of the coil elements on the external or outer side of either sewing thread. Punching is followed by extraction of the severed coil element fragments, which are plucked between the threads. Extraction occurs with the element fragments being crushed enough to be freed of the binding force of the sewing threads enabling eased removal without causing breakage in the threads. In addition, excessively long cut ends on the stringer coil elements are no longer left free on that end where the top stop, according to the aforesaid patent application, would have objectionable and possibly harmful projections. On the other hand, however, this utility model application is disadvantageous in that excessively long cut ends are left free on the other end of the stringer coil elements. When attaching such fittings as a box pin, pin and box for a separator to this end of the stringer coil elements, it is very difficult to make these ends stay in the box pin or pin. Consequently, the user has a protruding coil end on clothing to which this slide fastener is attached, which he will come into contact with and which may hurt him. In addition, this leads to so called "chain splitting" when used for a long time.

OBJECTS OF THE INVENTION

One object of the present invention is to provide a continuous slide fastener chain with interlocking synthetic resin coil elements having element-free sections at predetermined intervals along the length of the chain which has each of the cut ends of the elements secured in position in the threads, and which is suitable for massproduction at high speed.

Another object of the present invention is to provide a method of producing such a continuous slide fastener chain at high speed with increased efficiency.

Still another object of this invention is to provide a space forming punch for use in the formation of an element-free section on a continuous slide fastener chain.

Another object of this invention is to provide an apparatus for producing such a continuous slide fastener chain in conjunction with such a space forming punch.

Another object of this invention is to provide a slide fastener that is produced by dividing such a continuous slide fastener chain at the spaced sections and assembling a separator, a slider and a top stop.

SUMMARY OF THE INVENTION

The first feature of the present invention for a attaining the above objects is a continuous slide fastener chain in which a pair of stringers are prepared by sewing elongated coupling elements in the form of a continuous coil of synthetic resin to a pair of elongated continuous tapes with threads and element-free space sections are formed by removing a predetermined length of said inter-engaged coupling elements from the stringers at predetermined intervals. To form this spaced section, the coil coupling elements, while inter-engaged, are cut over a predetermined length on the inside and outside of the threads, such that the coil elements remaining on the stringers, after removal of severed element fragments, have their cut ends secured in place in the threads without the long, bent free cut ends associated with conventional slide fastener chains.

The second feature of the present invention is an improved method of manufacturing a continuous slide fastener chain, comprising steps of: sewing with thread to each of a pair of tapes along its inner edge a coupling element in the form of a coil of synthetic resin monofilament to produce a pair of stringers; and cutting and removing portions of the coil coupling elements over a predetermined length at predetermined intervals along the continuous slide fastener chain. The step of cutting and removing the coupling elements comprises the steps of, cutting at least one wind of said coupling elements at the leg portion thereof on the inner side of the sewing threads adjacent to one end of said spaced section;

cutting the remaining winds of said coupling elements at the connecting reversed portions thereof on the outer side of sewing threads adjacent to the other end of said spaced section; and removing the severed fragments of said coupling elements from the threads while they are seized and extracted in the direction perpendicular to the longitudinal direction of the stringers on the inner side of said threads so as to be freed from binding tension of the threads.

A punch for making spaced sections having a predetermined design into a pair of stringers in which a pair of elongated coupling elements in the form of continuous coils of synthetic resin monofilament are sewn to a pair of fastener tapes with sewing threads. The punch comprises:

a center projecting rib extending along a center line of the lower surface of a punch body and having substantially the same length as that of the spaced section to be formed;

a pair of parallel left and right inner cutting blades formed on the lower surface of the punch body, said inner cutting blades being spaced from the center projecting rib at a distance less than half the length between the pair of sewing threads to cut the upper leg portions of the coupling elements, said inner cutting blades having a short length in a longitudinal direction to cut at least one wind of the coupling elements adjacent to one end of the spaced section; and, a pair of parallel left and right outer cutting blades formed on the lower surface of the punch body, said outer blades being spaced from the center projecting rib at a distance longer than half of the length between the pair of sewing threads to cut the connecting reversed portions of the coupling elements, said outer cutting blades having a long length in a longitudinal direction to cut the remaining winds of the coupling elements adjacent to the other end of the spaced section to be formed.

In the preferred embodiments of the present invention, the overlapping of the inner and outer blade pairs, provided on both sides of the center projecting rib, is arranged within one pitch of the coil coupling elements so that both blade pairs will not cut the same element.

The fourth feature of the present invention is a space forming apparatus for producing element-free spaced sections of predetermined length at predetermined intervals in a continuous slide fastener chain, comprising a transfer table for intermittently transfering the continuous slide fastener chain, a die disposed in the center of the transfer table, a space forming punch movably disposed for movement in the direction perpendicular to the direction of transfer of the continuous slide fastener chain, a seizing device or ejector movably disposed for movement in the direction perpendicular to the direction of transfer of the slide fastener chain and dimensioned to match the size of the punch, and a chain fixing device located on both sides of the die and opposite sites to them for clamping and securing the right and left stringers.

The punch provided on this space processing apparatus is characterized by the provision of a center projecting rib extending along a center line of the lower surface of the punch body and having a substantially the same length as that of the spaced section to be formed;

a pair of parallel left and right inner cutting blades formed on the lower surface of the punch body, said inner cutting blades being spaced from the center projecting rib at a distance less than half of the length between the pair of sewing threads, to cut the upper leg portions of the coupling elements, said inner cutting blades having a short length in a longitudinal direction to cut at least one wind of the coupling elements adjacent to one end of the spaced section; and, a pair of parallel left and right outer cutting blades formed on the lower surface of the punch body, said outer blades being spaced from the central projecting rib at a distance longer than half of the length between the pair of sewing threads to cut the connecting reversed portions of the coupling elements, said outer cutting blades having a long length in a longitudinal direction to cut the remaining winds of the coupling elements adjacent to the other end of the spaced section to be formed.

The fifth feature of the present invention is a slide fastener comprising a pair of left and right tapes, coil coupling elements of synthetic resin monofilament sewn with thread to each of the tapes along the inner edge except for both upper and lower ear bends, an top stop attached to the upper portion of the tape pairs in such a manner as to conceal the cut ends of the right and left coupling elements, a separator consisting of a pin or male member, box and box pin or female member, and attached to the lower portion of the paired tapes in such a manner as to conceal the lower cut ends of the elements, the box made integral with the box pin and designed for releasable engagement of the pin, and a slider movably mounted on the coil elements for opening and closing the tapes.

According to this invention, the upper and lower ends of the coil coupling elements are positioned on the outer and inner sides of the sewing threads closely thereto so that they are held firmly by the sewing threads. Therefore, said upper stops are attaching the upper end portions of the coupling elements to the pair of stringers with the upper ends of the coupling elements being held firmly by the sewing threads, and, said pin and box pin are secured to the lower ear bends of the stringers so as to conceal thereunder the lower end portions of the coupling elements, while the lower ends of the coupling elements are held firmly by the sewing threads.

Other features and advantages of the present invention will be appreciated from study of the following detailed description of the preferred embodiments in conjunction with the accompanying drawings.

BRIEF DESCRIPTION OF THE DRAWINGS

FIG. 1 is a partial plan view of a continuous slide fastener chain as manufactured according to the present invention;

FIG. 6 is a plan view of a completed slide fastener;

FIG. 7(*b*) is a bottom view of punch of FIG. 7(*a*);

DETAILED DESCRIPTION OF THE PREFERRED EMBODIMENTS

While embodiments of the present invention will be described hereinafter with reference to the drawings, it is to be understood that arrangements having the construction which is described in the scope of the claims of the specification as being the essential structural elements of the present invention fall within the technical scope of the present invention even if arrangements differ in form from the embodiments exemplified hereinafter.

Figure 2:
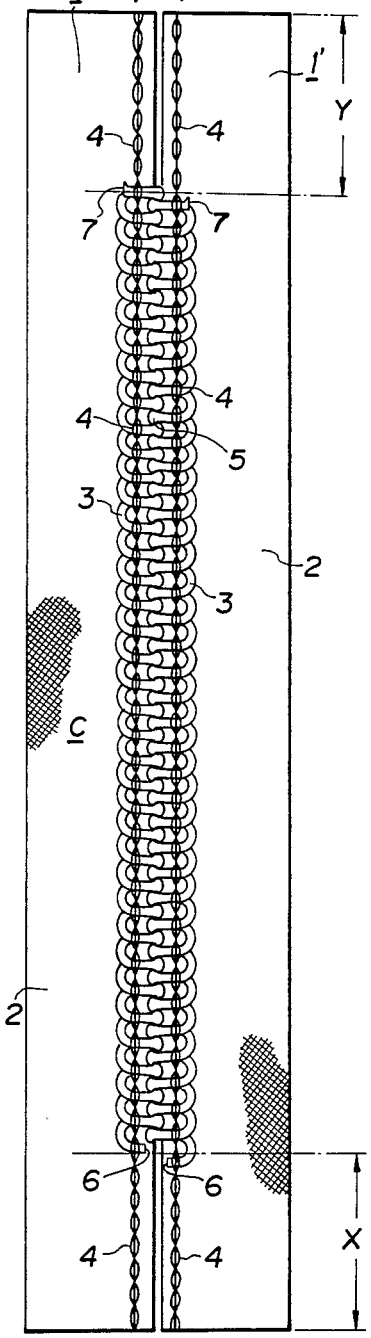
FIG. 2 is a plan view of a slide fastener chain as manufactured according to the present invention.

Referring to FIG. 1, in particular, and other drawings, a portion of a continuous slide fastener chain according to the present invention is designated by alphabetical letter A. In the drawings, numerals 1, 1' designate left and right stringers, respectively, numeral 2 designates a stringer or fastener tape, numeral 3 designates a coupling element in the form of a coil comprising a length of continuous, synthetic resin monofilament. Numeral 4 denotes a sewing thread for sewing the element 3 to the stringer tape 2, numeral 5 denotes an inter-engaging head portion of the element 3 on the pair of the stringers 1, 1'. On the continuous slide fastener chain A is formed at predetermined intervals an element-free section or a spaced section B of predetermined length. A slide fastener chain C, as shown in FIG. 2, is produced by cutting the continuous slide fastener chain A transversely at the center of the spaced section B along transverse planned cutting line L, L. Regarding this planned cutting line as a dividing line, the section largely designated at X is a half section in the spaced section B adjacent to the slide fastener chain on the side to which a separator is attached. On the other hand, the section largely indicated at Y is also a half space, in this case adjacent to the slide fastener chain on the side to which a top or upper stop is attached.

A feature of the continuous slide fastener chain according to the present invention is in the method of forming the spaced section B. It is so arranged that, when the interlocking coil elements are cut, to form the spaced section B, the element cut ends 6 of the paired stringers adjacent to the section X are situated on the inner side of the thread 4, while the element cut ends 7 adjacent to the section Y are located on the outer side of the sewing thread 4. Since the cut ends 6 and 7, occurring at upper leg portions and connecting reversed portions, respectively, are cut adjacent to the thread, they are secured in position without dangling or causing interference or disturbance.

Figure 3:
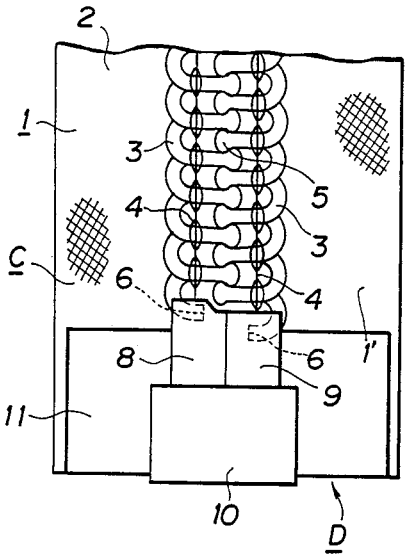
FIG. 3 is a plan view of a spaced section to which a separator is attached.

In FIG. 2, there is shown a slide fastener chain C produced by cutting the continuous slide fastener chain A transversely along transverse planned cutting line L, L. A complete slide fastener as shown in FIG. 6 is produced when the slide fastener chain C is attached on the side adjacent to the section X with a separator D comprising a pin 8, box 10 and box pin 9 and on the side adjacent to the section Y with a top stop 12, and a slider 14 engaged in the interlocking coil elements 3 being sewn to the paired stringers 1, 1'. Referring to FIG. 3, the pin 8 of substantially U-shaped cross section and box pin 9 are each attached to the stringer pair 1, 1', respectively, at the spaced section X. If the cut ends 6 of the coupling elements 3 were situated on the outer side of the thread 4, as in the case of Japanese Utility Model Application No. 197537/81, the cut ends will be too bulky to be inserted into the pin 8 or box pin 9 because of their dangling tendency. Even if they are force onto the pin, some part of the element may remain projecting from under the pin. Those projecting cut ends are likely to hurt the user or cause so called chain breaking when used for a long time. The effects of the slide fastener according to the present invention are such that the cut ends 6 of the coupling elements, which are adjacent to the spaced section X on the side to which the separator is attached, are situated on the inner sides of the sewing threads 4 and the coupling elements 3 are firmly held by the sewing threads 4 closely thereto while the overlapping between the flanks of the fitting and the cut ends is relatively large. When the cut end is attached with a pin 8 or box pin 9, a connection is formed between the fitting and the elements. In consequence, the fittings are affixed to the stringers with greater strength, and previous problems such as chain splitting are prevented. In attachment, after fixing the pin 8 and box pin 9 about the respective cut ends 6, which are situated in the stringers 1, 1' on the side of the section X, the box pin 10 is affixed about the box pin 9.

Figure 4:
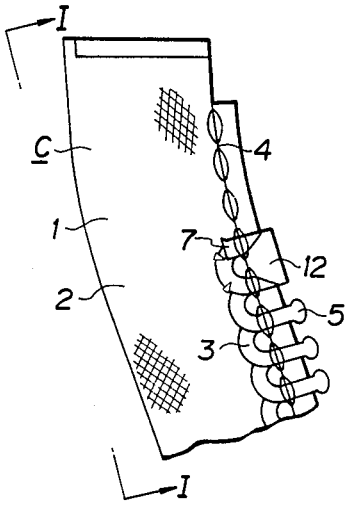
FIG. 4 is a plan view of a stringer to which an upper or top stop is attached.
Figure 5:
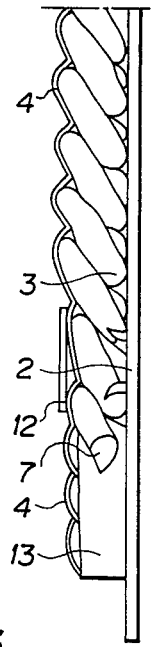
FIG. 5 is a side view seen from I—I of FIG. 4.

Referring then to FIGS. 4 and 5, the cut ends 7 of the elements 3, which are adjacent to the spaced section Y, are attached with top stops 12 at the upper end of the stringers 1, 1'. As shown in the drawings, the top stops 12 hold the one wind including the cut ends 7 of the coupling elements 3 adjacent to the spaced section Y to the stringer tapes 2 firmly by means of three notch-like fingers. The top stops 12 limit the upward movement of the slider 14 so as not to drop the slider therefrom. In contrast, if the cut ends 7 occur outside the sewing threads 4, as in the case of aforesaid Japanese Patent Application No. 156104/81, the cut ends 7 are likely to be left, after attachment of the top stops, projecting from and not concealed neatly by the top stop 12 thus causing problems of deterioration in touch and harm to the skin of the user. The slide fastener chain C of this invention, on the other hand, has its cut ends 7 just inside the thread 4, cut adjacent to the spaced section Y, and firmly secured in position by the thread 4 and, when fitted with a top stop, concealed neatly within the thickness of the top stop, so that there are no particular problems, and there is an improvement in feel.

In FIG. 5, numeral 13 designates a core cord, which extends within each of the stringers 1, 1' along their inside edge. In the other drawings, this core yarn or cord 13 is omitted for clarity's sake.

Figure 7A:
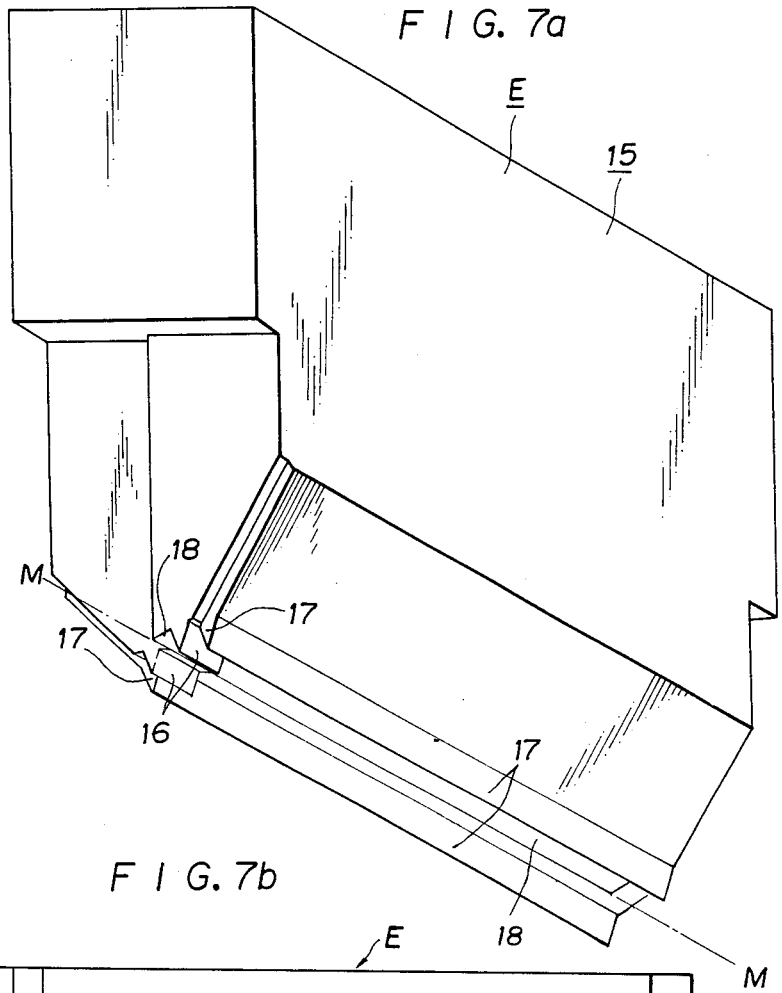
FIG. 7(*a*) is a perspective view of a punch for forming spaced sections on a continuous slide fastener chain.
Figure 7B:
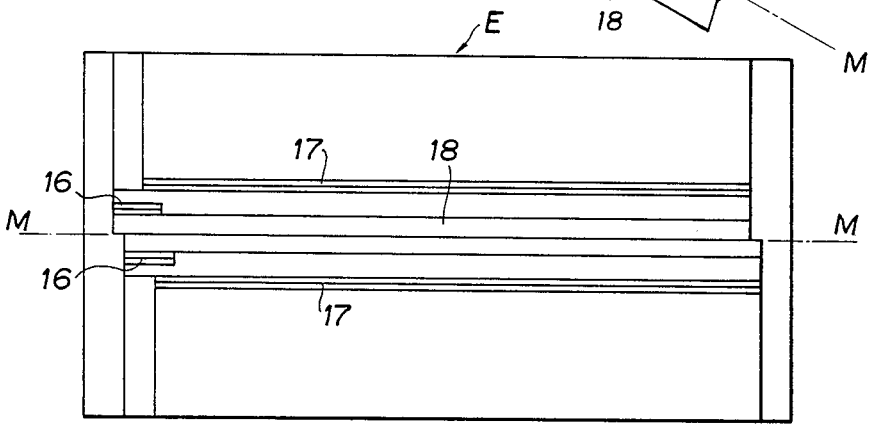

Referring to FIGS. 7(*a*) and 7(*b*), a punch, largely indicated at E, is shown which forms the spaced sections B on a continuous slide fastener chain A as in FIG. 1.

The main body 15 of the punch E comprises a pair of parallel, right and left inner cutting blades 16 of short span mounted in the bottom surface of the punch E, a pair of parallel right and left outer cutting blades 17 of long span, disposed parallel to and outside of the inner cutting blands, and a center projecting rib 18, parallel to and inside the inner and outer cutting blades, of a size related to the dimension of the spaced section B.

As shown in FIG. 7(*b*), the inner cutting blades 16 of short span, disposed symmetrically with respect to the center line M of the punch E, make cutting on the upper leg portions 24 of the inter-engaged elements 3 within the left and right sewing threads 4, 4 on the side of the fastener to which a separator is attached, and for this purpose, are spaced just enough from the projecting rib 18 in the center, with their blade span selected to cut at least one wind of the element adjacent to the spaced section X. In one preferred embodiment according to this invention, the blade span each of the inner cutter 16 is dimensioned just to cut an only one wind or loop of interlocking coil element. On the other hand, the outer cutting blade pair 17 are spaced enough from the center projecting rib 18 to perform cutting on the connecting reversed portions 25 outside the sewing threads 4, 4 on the side of the slide fastener to which a top stop is attached, with their blade span determined to match the large number of winds of the elements or, in this preferred embodiment, what is left uncut by the inner blade pair 16.

The projecting rib 18 is located on the bottom of the punch body 15 along the center line M between the two pairs of cutting blades 16, 17 for cooperating with the blades 16, 17 and with an ejector 22 hereunder described to seize the inter-engaging head portions of the left and right inter-engaged elements 3 after the elements are cut by the cutting blades 16, 17 during which time the severed fragments of coil element are extracted in flattened condition from the sewing threads 4. The overlapping of the cutting blades 16, 17 is arranged within one pitch of the coupling element so that both blades will not cut the same element, otherwise such cutting of the same element 3 by both blades 16 and 17 would leave the severed fragments of coil coupling element 3 remaining between the sewing threads 4, making removal a time-consuming operation. Further, the reason for making the cutting blades 16 for the inside as short as possible and elongating the outer cutting blade is that, when performing the cutting on the inner side, the sewing thread 4 is tightly entwined on the element 3, making removal of the severed elements difficult, as described in connection with Japanese Patent Application No. 197537/81. Therefore, the severed fragments of coil coupling element are extracted from the sewing threads 4 while offering little resistance, so that perfect extraction of the severed piece is insured and loss of threads reduced.

In addition, as shown in FIG. 7(*b*) and 8, the positions of the cutting blades 16, 17 on both sides of the center line M are staggered by a half pitch of coupling element to prevent cutting of more of the element leg than planned.

Moreover, though the projecting rib 18 is shown to be pointed in shape in the drawings, it goes without saying that any other shape can be taken by it. For example, by taking a trapezoidal shape in which the upper surface is flattened, the seizure of the severed fragment may be assured.

Figure 9:
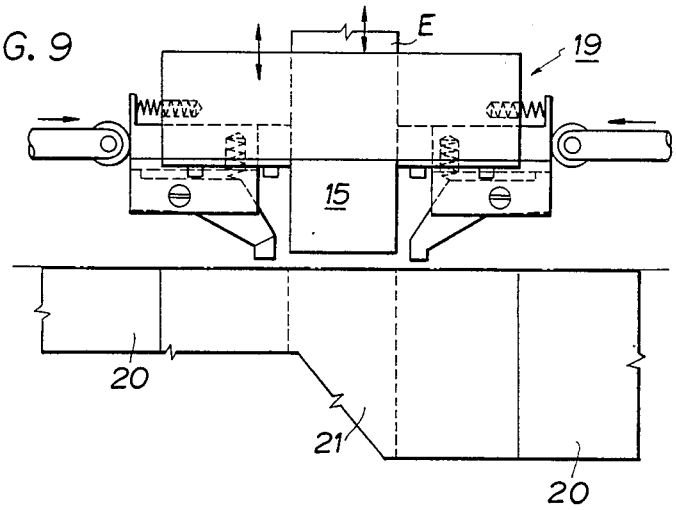
FIG. 9 is a side view illustrating the general features of the space processing apparatus according to the present invention.

Referring now to FIG. 9, letter 19 designates largely a space processing apparatus, which may carry the punch E of FIGS. 7(*a*) and (*b*).

The space processing apparatus 19 comprises in the main a transfer table 20 for transferring the continuous slide fastener chain A, a die 21 disposed in the center of the transfer table 20, and a punch E, which is similar to the one depicted in FIGS. 7(*a*) and (*b*), disposed in alignment with and opposite to the die 21. The transfer table 20 is placed horizontally or vertically with respect to a base and transfers the continuous slide fastener chain A intermittently in conjunction with a chain guide and feeding device (not shown). The die 21 and punch E operate in cooperation to cut and remove the element 3 at a portion which is to be formed into a spaced section B of a prescribed length on the continuous slide fastener chain A, as the transfer table 20 stops the continuous chain into fixed position.

Figure 10A:
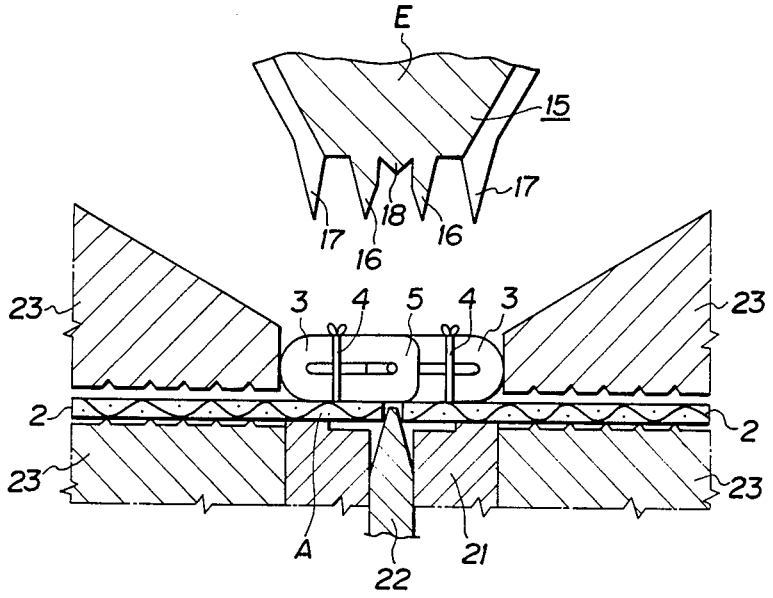
FIGS. 10(*a*), (*b*), and (*c*) are descriptive views illustrating the operation process on the side at which the separator is attached in the fastener production method in accordance with the present invention.
Figure 10B:
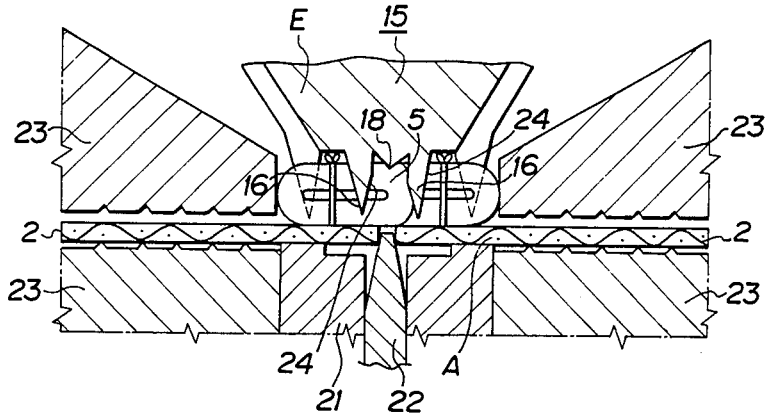
Figure 10C:
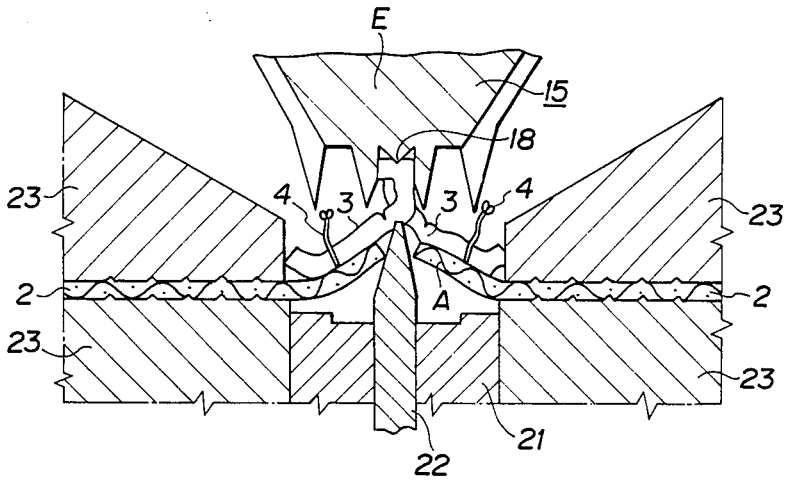

Referring to FIGS. 10(*a*) through (*c*) and 11(*a*) through (*c*), the process for forming the spaced section B will be described in great detail.

In the drawings, numeral 22 designates an ejector or seizing device of approximately the same longitudinal dimension as that of the punch E, disposed in the center of the die 21 opposite the punch E. The ejector 22 operates in cooperation with the center projecting rib 18 formed on the bottom of the punch E to seize and extract from the sewing threads 4 the severed fragment of coil coupling element, when it is cut by the punch E to form a spaced section B. Numeral 23 designates a chain fixing device, which is designed to clamp and secure vertically or horizontally the stringer tape 2, 2 so as to facilitate the operation of the center projecting rib 18 and ejector 22 to extract and remove the element fragments severed by the punch E from the threads 4. This chain fixing device 23 is located on both sides of the die 21 and the opposite sites to them.

Figure 8:
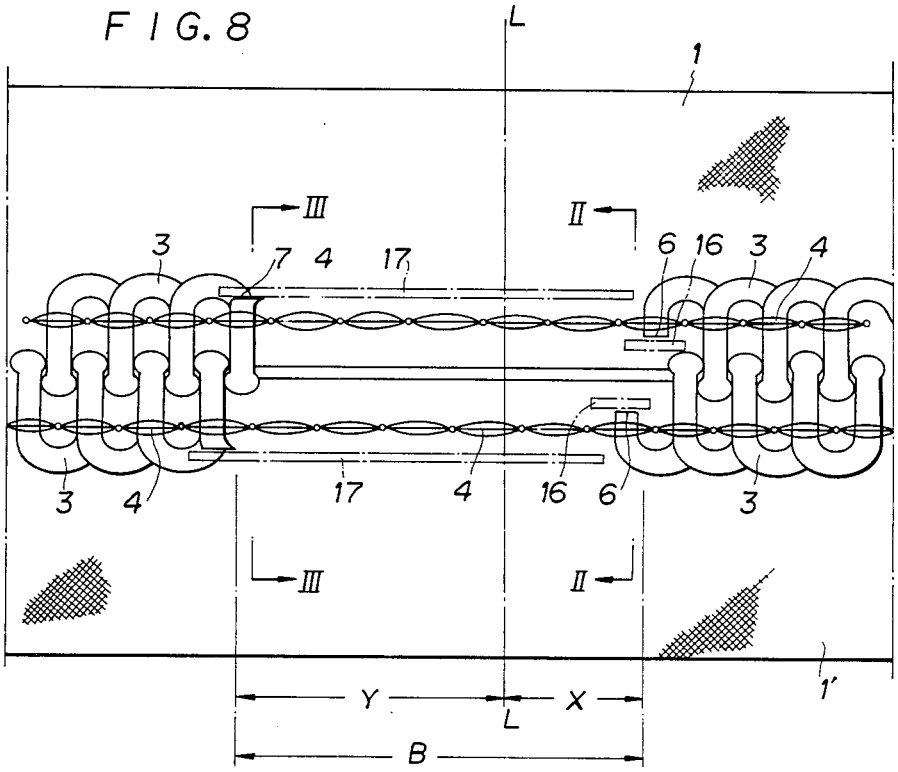
FIG. 8 is a descriptive plan view illustrating the relation between a spaced section and the cutting blades of the punch of FIG. 7(*a*)

FIGS. 10(*a*) through (*c*) are each cross sectional views taken along line II—II of FIG. 8. FIG. 10(*b*) shows the instant at which the spaced section is just being formed (shows the neutral position of the space processing apparatus ). FIG. 10(*b*) shows the instant at which the elements 3 are cut at the upper legs 24 on the inner sides of the sewing threads 4 by the set of inner cutting blades 16 of short span. FIG. 10(*c*) shows the state in which the punch E and ejector 22 operate in cooperation to extract and remove the severed segments of interlocked coil elements from the threads 4.

Referring to FIG. 10(*b*), at the moment when the coupling elements 3 are cut by the inner cutting blades 16 on the punch E, the inter-engaging head portions 5 of the pair of left and right coupling elements 3 are seized in flattened state by the center projecting rib 18 and ejector 22, but the fixing device 23 is not yet operational at this stage. At this time, the number of severed fragments produced by the inner cutting blades 16 of short span of the punch E is, in the preferred embodiments, one or few. Owing to the minimum number of the inter-engaged coil elements cut, these fragments are not troublesome to remove from the sewing threads 4.

At the stage of the operation as shown in FIG. 10(*c*), the stringer tapes 2, 2 are fixed in position by the chain fixing device 23 and the punch E and ejector 22 are displaced simultaneously from the fixed position of the stringer tapes 2, extracting and removing the severed fragments of inter-engaged coil elements from the sewing threads 4.

Figure 11A:
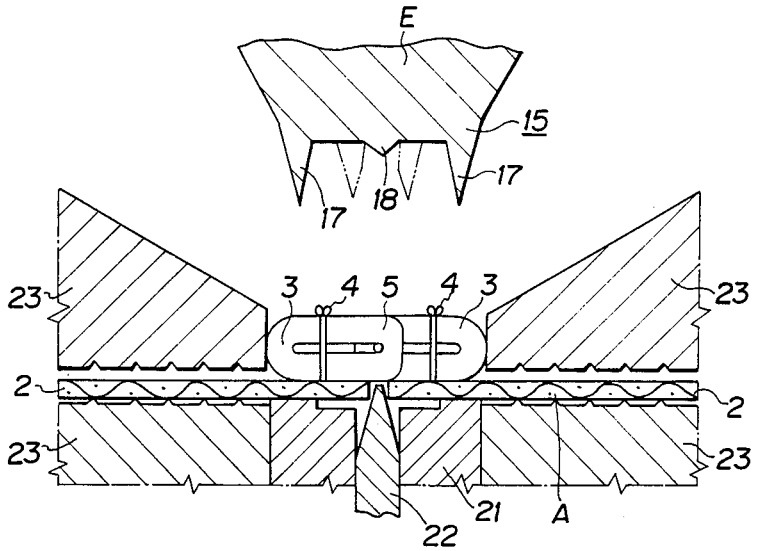
FIGS. 11(*a*), (*b*), and (*c*) are descriptive sectional views illustrating the operating process of the upper or top stop.
Figure 11B:
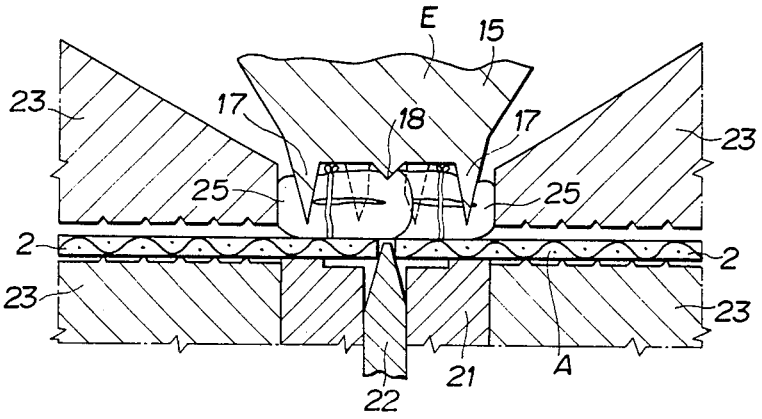
Figure 11C:
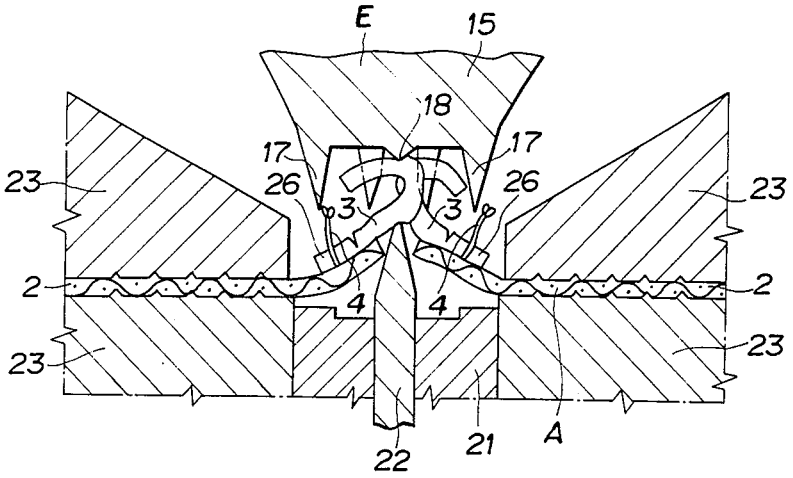

FIGS. 11(*a*) through (*c*) are each cross sectional views taken along III—III of FIG. 8. FIG. 11(*a*) is a view showing the arrangement prior to operation of the space processing apparatus. FIG. 11(*b*) shows the connecting reversed portions 25 of the element 3 on the outer side of the sewing thread 4 as they are cut by the outer cutting blades 17 of long span of the punch E. FIG. 11(*c*) shows the stage that the punch E and ejector 22 are operating in cooperation to remove the severed fragments from the sewing threads 4.

Referring back to FIG. 11(*b*), at the point when the inter-engaged coil elements 3 are cut at connecting reversed portions 25 on the outer sides of the sewing threads 4 by the paired outer cutting blades 17 of long span formed on the bottom of the punch E, the inter-engaged heads 25 of right and left coil elements 3 are seized into flattened condition by the center projecting rib 18 and ejector 22. At this time since the severed fragments of inter-engaged coil elements 3 are flattened at their head portions, they can be extracted from the sewing threads 4 with little resistance. Accordingly, the large number of severed fragments of the coupling elements produced by the cut of long blade span can be smoothly removed. At the stage of FIG. 11(*b*), the chain fixing device 23 is not yet put into action.

The condition of the chain in FIG. 11(*c*) is similar to that shown in FIG. 10(*c*).

As stated earlier, since the two sets of cutting inner and outer blades 16 and 17 are provided to form integral parts of the punch E on its bottom surface, the foregoing cutting, shown in particular detail in FIGS. 10(*b*) and 11(*b*), and element fragment removal, shown in detail in FIGS. 10(*c*) and 11(*c*), are performed simultaneously.

Upon formation of the spaced section B on the continuous slide fastener chain in the above described manner, these members including the chain fixing device 23 are, as a matter of course, restored to the positions which prevailed prior to their operation, the fastener chain being released. The continuous slide fastener chain A is then transferred again by a predetermined length on the transfer table 20 by the transfer device, so that the location to serve as the next spaced section is brought to the position of the space section processing apparatus 19. At such time, the transfer is halted again and the process for the formation of a new spaced section begins.

As is explained in great detail in the above specification, the spaced section B can be produced on continuous slide fastener chain A in large numbers at high speed yet with increased ease and efficiency by the punch E shown in FIG. 7 according to the present invention. The individual slide fastener chain C produced from the space-formed continuous slide fastener chain A by cutting transversely through the spaced sections B has the cut ends 6,7 of interlocking right and left coil elements 3 secured in position at either end without excessively protruding from the sewing threads 4. Thus, the cut ends are firmly held by the threads 4 on the stringers in position. Consequently, fittings such as the pin 8, pin box 9 and top stop 12 which are fitted about the coil element at either end of the fastener stringers 3 can be fixed in position in greater strength, without having unconcealed element cut ends protruding from their mount. Therefore, the product or slide fastener made from the continuous slide fastener chain A is in no risk of experiencing chain splitting and can be provided with excellent touch and feel, without exposing the user of clothing on which this slide fastener is attached to harmful projecting element cut ends.

In addition, the continuous slide fastener chain in the form of FIG. 1 is also superior in that it can be stored, transported and marketed while coiled in long lengths as an intermediate in-progress article, can be subjected to cutting and finishing work at the place of destination or business, if required, to produce the unit slide fastener, as shown in FIG. 6, after being cut and furnished with the fitting (a separator D, slider 14 and top stop 12) for sale. Otherwise, slide fastener chains as shown in FIG. 6 are, of course, handled in the form of half-products, or in the state of the completed slide fastener as in FIG. 6.

Further, the punch E shown in FIG. 7 is most effective and reliable in forming the spaced section B on continuous slide fastener chain A of FIG. 1 and provides the cutting in which a small number of the interlocking coil elements are cut on the inner side of the sewing thread, while the remaining large number are cut on the outer side of the thread, so that the resultant severed fragments of the coupling elements can be easily extracted and removed. As a result, the efficiency of the space processing operation is raised, non/removal of the fragments and breaking of sewing threads are extremely reduced, and quality and yield are thereby improved.

I claim:

1. A punch for making spaced sections having a predetermined design into a pair of stringers in which a pair of elongated coupling elements in the form of continuous coils of synthetic resin monofilament are sewn to a pair of fastener tapes with sewing threads; said punch comprising:

a center projecting rib extending along a center line of the lower surface of a punch body and having substantially the same length as that of the spaced section to be formed;

a pair of parallel left and right inner cutting blades formed on the lower surface of the punch body, said inner cutting blades being spaced from the center projecting rib at a distance less than half off the length between the pair of sewing threads to cut the upper leg portions of the coupling elements, said inner cutting blades having a short length in a longitudinal direction to cut at least one wind of the coupling elements adjacent to one end of the spaced section; and a pair of parallel left and right outer cutting blades formed on the lower surface of the punch body, said outer blades being spaced from the center projecting rib at a distance longer than half of the length between the pair of sewing threads to cut the connecting reversed portions of the coupling elements, said outer cutting elements having a long length in a longitudinal direction to cut the remaining winds of the coupling elements adjacent to the other end of the spaced section to be formed.

2. A punch according to claim 1 wherein the inner and outer cutting blade pairs formed on the left and right sides of the center projecting rib are offset in a half pitch of the coupling elements in a longitudinal direction of the stringer.

3. A punch according to claim 1 wherein the overlapping of the inner and outer blade pairs, provided on both sides of the projecting rib, is arranged within one pitch of the coil coupling element so that both blade pairs will not cut the same element.

4. A space forming apparatus for producing an element-free spaced section of predetermined length at predetermined intervals in continuous slide fastener chain, comprising a transfer table for intermittently transfering the continuous slide fastener chain, a die disposed in the center of the transfer table, a space forming punch movably disposed for movement in the direction perpendicular to the direction of transfer of the slide fastener chain, a seizing device or ejector movable disposed for movement in the direction perpendicular to the direction of transfer of the slide fastener chain and sized to match that of the punch, and a chain fixing device located on both sides of the die and opposite sites to them for clamping and securing the right and left stringers, said space forming apparatus being characterized in that the punch comprises:

a center projecting rib extending along a center line of the lower surface of the punch body and having substantially the same length as that of the spaced section to be formed;

a pair of parallel left and right inner cutting blades formed on the lower surface of the punch body, said inner cutting blades being spaced from the center projecting rib at a distance less than half of the length between the pair of sewing threads to cut the upper leg portions of the coupling elements, said inner cutting blades having a short length in a longitudinal direction to cut at least one wind of the coupling elements adjacent to one end of the spaced section; and a pair of parallel left and right outer cutting blades formed on the lower surface of the punch body, said outer blades being spaced from the center projecting rib at a distance longer than half of the length between the pair of sewing threads to cut the connecting reversed portions of the coupling elements, said outer cutting elements having a long length in a longitudinal direction to cut the remaining winds of the coupling elements adjacent to the other end of the spaced section to be formed.

5. A space forming apparatus according to claim 4 wherein said inner and outer cutting blade pairs formed on the left and right sides of the center projecting rib are offset in a half pitch of the coil coupling elements in a longitudinal direction of the stringers.

6. A space forming apparatus according to claim 4 wherein said overlapping of the inner and outer blade pairs, provided on both sides of the center projecting rib, is arranged within one pitch of the coupling elements so that both blade pairs will not cut the same element.

* * * * *